US008142970B2

(12) United States Patent
Lai et al.

(10) Patent No.: US 8,142,970 B2
(45) Date of Patent: Mar. 27, 2012

(54) TONER COMPOSITIONS

(75) Inventors: Zhen Lai, Webster, NY (US); Yuhua Tong, Webster, NY (US); Chieh-Min Cheng, Rochester, NY (US); Peter V. Nguyen, Webster, NY (US); Jon T. Owens, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/861,980

(22) Filed: Aug. 24, 2010

(65) Prior Publication Data

US 2011/0039199 A1 Feb. 17, 2011

Related U.S. Application Data

(62) Division of application No. 11/515,659, filed on Sep. 5, 2006, now Pat. No. 7,794,911.

(51) Int. Cl.
*G03G 9/093* (2006.01)

(52) U.S. Cl. ..... 430/108.11; 430/108.24; 430/108.3; 430/110.2

(58) Field of Classification Search ..... 430/110.2, 430/108.11, 108.24, 108.3
See application file for complete search history.

(56) References Cited

U.S. PATENT DOCUMENTS

| | | | |
|---|---|---|---|
| 2,874,063 | A | 3/1953 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,265,990 | A | 5/1981 | Stolka et al. |
| 4,394,430 | A | 7/1983 | Jadwin et al. |
| 4,560,635 | A | 12/1985 | Hoffend et al. |
| 4,563,408 | A | 1/1986 | Lin et al. |
| 4,584,253 | A | 4/1986 | Lin et al. |
| 4,797,339 | A | 1/1989 | Maruyama et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,213,938 | A | 5/1993 | Sacripante et al. |
| 5,215,855 | A | 6/1993 | Keoshkerian et al. |
| 5,227,460 | A | 7/1993 | Mahabadi et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 5,928,830 | A | 7/1999 | Cheng et al. |
| 6,004,714 | A | 12/1999 | Ciccarelli et al. |
| 6,190,815 | B1 | 2/2001 | Ciccarelli et al. |
| 6,326,117 | B1 | 12/2001 | Ishihara |
| 7,553,601 | B2 | 6/2009 | Lai |
| 2002/0187415 | A1 | 12/2002 | Jiang et al. |
| 2004/0152004 | A1 | 8/2004 | Serizawa et al. |
| 2004/0191666 | A1 | 9/2004 | Kamadi et al. |
| 2004/0197693 | A1 | 10/2004 | Ninomaya |
| 2006/0105263 | A1 | 5/2006 | Moffat et al. |
| 2006/0166121 | A1 | 7/2006 | Patel et al. |
| 2006/0204882 | A1 * | 9/2006 | Nozaki et al. ..... 430/110.2 |

FOREIGN PATENT DOCUMENTS

| | | |
|---|---|---|
| EP | 1 777 591 | 4/2007 |
| EP | 1 808 733 | 7/2007 |

OTHER PUBLICATIONS

International Search Report for European Application No. EP 07 11 0188 dated Jul. 14, 2009.
International Search Report for European Application No. EP 07 11 5710 dated Nov. 20, 2009.

* cited by examiner

*Primary Examiner* — Janis L Dote

(57) ABSTRACT

A toner having a core with a first latex having a specific glass transition temperature, and further having a shell surrounding the core with a second latex having a specific glass transition temperature and possessing functional groups, and processes for producing the same.

6 Claims, 2 Drawing Sheets

TONER COMPOSITIONS

This application is a divisional of U.S. patent application Ser. No. 11/515,659, filed on Sep. 5, 2006, now U.S. Pat. No. 7,794,911 the entire disclosure of which is incorporated by reference herein.

BACKGROUND

Numerous processes are known for the preparation of toners, such as, for example, conventional processes wherein a resin is melt kneaded or extruded with a pigment, micronized and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner can also be produced by emulsion aggregation methods. Methods of preparing an emulsion aggregation (EA) type toner are known and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally, but in embodiments, an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.1 to about 50 percent by weight, or from about 3 to about 25 percent by weight, of the monomer emulsion prepared in (i), and (b) a free radical initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared in (ii), and optionally a free radical initiator, from about 0 to about 99.5 percent by weight, or from about 0 to about 97 percent by weight, of the total initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Placing charge on the particles utilized to form toner, to enable movement and development of images via electric fields, is most often accomplished with triboelectricity. Triboelectric charging may occur either by mixing the toner with larger carrier beads in a two component development system, or by rubbing the toner between a blade and donor roll in a single component system. A stable triboelectric charge is very important to enable good toner performance.

The sensitivity of toner charge to relative humidity (RH) has been a consistent problem for developers in general, and for color developers in particular, mainly due to the fact that the surfaces of toner particles may be very sensitive to relative humidity. Sensitivity to relative humidity may give rise to various problems, including toner particle agglomeration and clogging of the apparatus using such toner.

Improved methods for producing toner, which minimize sensitivity to relative humidity and are capable of utilizing existing processing equipment and machinery, remain desirable.

SUMMARY

The present disclosure provides processes for producing toners and toners produced thereby. In embodiments, the process of the present disclosure includes contacting a first latex having a glass transition temperature from about 45° C. to about 65° C., an aqueous colorant dispersion, and an optional wax dispersion to form a blend, adding a base to increase the pH to a value of from about 4 to about 7, heating the blend at a temperature below the glass transition temperature of the latex to form an aggregated toner core, adding a second latex having a glass transition temperature from about 45° C. to about 70° C. to the aggregated toner core, wherein the second latex possesses functional groups and forms a shell over said toner core forming a core-shell toner, heating the core-shell toner at a temperature above the glass transition temperature of the latex, and recovering the toner.

In embodiments the core-shell toner may be heated to a temperature above the glass transition temperature of both the latex utilized to form the core and the latex utilized to form the shell.

In other embodiments, a process according to the present disclosure includes contacting a first latex including a poly (styrene-butyl acrylate) having a glass transition temperature from about 45° C. to about 65° C., an aqueous colorant dispersion, and an optional wax dispersion to form a blend. A base is then added to increase the pH to a value of from about 4 to about 7 and the blend is then heated at a temperature from about 30° C. to about 60° C. to form an aggregated toner core. A second latex including a poly(styrene-butyl acrylate) having a glass transition temperature from about 45° C. to about 70° C. is added to the aggregated toner core, wherein the second latex possesses functional groups such as silanes, fluoro acrylates, fluoro methacrylates, fluoro styrenes, and combinations thereof and forms a shell over said toner core forming a core-shell toner. The core-shell toner may then be heated at a temperature from about 80° C. to about 120° C. the resulting toner recovered.

The present disclosure also provides toners including a core of a first latex having a glass transition temperature from about 45° C. to about 65° C., a colorant, and an optional wax, and a shell including a second latex having a glass transition temperature from about 45° C. to about 70° C. functionalized with monomers such as silanes, fluoro acrylates, fluoro methacrylates, fluoro styrenes, and combinations thereof.

Toners of the present disclosure may possess particles having a size from about 1 micron to about 20 microns, and a circularity from about 0.9 to about 0.99. The toner particles may also possess a ratio of J-Zone charge to B-Zone charge from about 1 to about 2, and a ratio of J-Zone charge to A-Zone charge from about 1.15 to about 2.55.

BRIEF DESCRIPTION OF THE DRAWINGS

Various embodiments of the present disclosure will be described herein below with reference to the figures wherein.

DETAILED DESCRIPTION OF EMBODIMENTS

Figure 1:
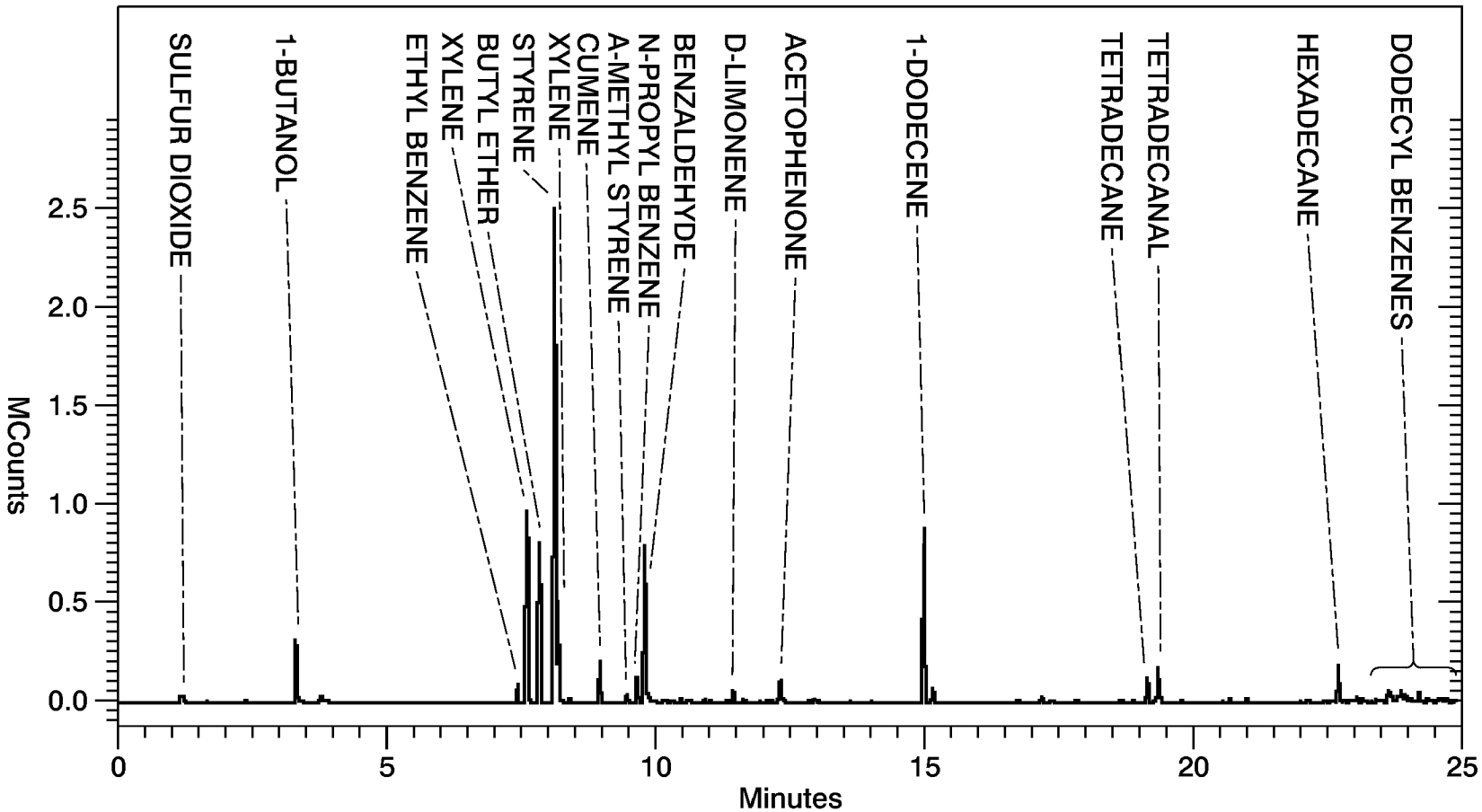
FIG. 1 includes a graph depicting gas chromatography/mass spectroscopy (GC/MS) test results of a conventional toner.

The present disclosure provides processes for the preparation of toner particles having reduced sensitivity to relative humidity. In embodiments, the processes include the synthesis of a latex having a core-shell configuration with functional groups in the latex shell which render the shell more hydrophobic and thus less sensitive to relative humidity. In embodiments, the present disclosure includes the preparation of toner by blending a colorant and a wax with a latex polymer core, optionally with a flocculant and/or charge additives; and heating the resulting mixture at a temperature below the glass transition temperature (Tg) of the latex polymer to form toner sized aggregates. A functionalized latex may then be added as a shell latex, followed by the addition of a base and cooling. Subsequently heating the resulting aggregate suspension at a temperature at or above the Tg of the latex polymer will result in coalescence or fusion of the core and shell, after which the toner product may be isolated, such as by filtration, and thereafter optionally washed and dried, such as by placing in an oven, fluid bed dryer, freeze dryer, or spray dryer.

Toners of the present disclosure may include a latex in combination with a pigment. While the latex may be prepared by any method within the purview of one skilled in the art, in embodiments the latex may be prepared by emulsion polymerization methods and the toner may include emulsion aggregation toners. Emulsion aggregation involves aggregation of both submicron latex and pigment particles into toner size particles, where the growth in particle size is, for example, from submicron, in embodiments from about 3 microns to about 10 microns.

Any monomer suitable for preparing a latex emulsion can be used in the present processes. Suitable monomers useful in forming the latex emulsion, and thus the resulting latex particles in the latex emulsion include, but are not limited to, styrenes, acrylates, methacrylates, butadienes, isoprenes, acrylic acids, methacrylic acids, acrylonitriles, mixtures thereof, and the like.

In embodiments, the resin of the latex may include at least one polymer. In embodiments, at least one may be from about one to about twenty and, in embodiments, from about three to about ten. Exemplary polymers includes styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(styrene-butylacrylate), poly (methylstyrene-butadiene), poly(methyl methacrylate-butadiene), poly(methyl methacrylate-isoprene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(acrylonitrile-butyl acrylate-acrylic acid), and mixtures thereof. The polymer may be block, random, or alternating copolymers. In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol may also be used.

In embodiments, a poly(styrene-butyl acrylate) may be utilized as the latex. The glass transition temperature of this first latex which, in embodiments may be used to form the core of a toner of the present disclosure, may be from about 45° C. to about 65° C., in embodiments from about 48° C. to about 62° C.

In embodiments, the latex may be prepared in an aqueous phase containing a surfactant or co-surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., mixtures thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, and the like, and mixtures thereof. In embodiments a suitable cationic surfactant includes SANISOL B-50 available from Kao Corp., which is primarily a benzyl dimethyl alkonium chloride.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, mixtures thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be selected.

The choice of particular surfactants or combinations thereof as well as the amounts of each to be used are within the purview of those skilled in the art.

In embodiments initiators may be added for formation of the latex. Examples of initiators include water soluble initiators, such as ammonium persulfate, sodium persulfate and potassium persulfates, and organic soluble initiators including organic peroxides and azo compounds including Vazo peroxides, such as VAZO 64™, 2-methyl 2-2'-azobis propanenitrile, VAZO 88™, and 2-2'-azobis isobutyramide dehydrate and mixtures thereof. Initiators can be added in suitable amounts, such as from about 0.1 to about 8 weight percent, and in embodiments of from about 0.2 to about 5 weight percent of the monomers.

In embodiments chain transfer agents may be utilized including dodecane thiol, octane thiol, carbon tetrabromide, mixtures thereof, and the like, in amounts from about 0.1 to about 10 percent and, in embodiments, from about 0.2 to about 5 percent by weight of monomers, to control the molecular weight properties of the polymer when emulsion polymerization is conducted in accordance with the present disclosure.

In some embodiments a pH titration agent may be added to control the rate of the emulsion aggregation process. The pH titration agent utilized in the processes of the present disclosure can be any acid or base that does not adversely affect the products being produced. Suitable bases can include metal hydroxides, such as sodium hydroxide, potassium hydroxide, ammonium hydroxide, and optionally mixtures thereof. Suitable acids include nitric acid, sulfuric acid, hydrochloric acid, citric acid, acetic acid, and optionally mixtures thereof.

In the emulsion aggregation process, the reactants may be added to a suitable reactor, such as a mixing vessel. The appropriate amount of at least two monomers, in embodiments from about two to about ten monomers, stabilizer, surfactant(s), initiator, if any, chain transfer agent, if any, and wax, if any, and the like may be combined in the reactor and the emulsion aggregation process may be allowed to begin. Reaction conditions selected for effecting the emulsion polymerization include temperatures of, for example, from about 45° C. to about 120° C., in embodiments from about 60° C. to about 90° C. In embodiments the polymerization may occur at elevated temperatures within 10 percent of the melting point of any wax present, for example from about 60° C. to about 85° C., in embodiments from about 65° C. to about 80° C., to permit the wax to soften thereby promoting dispersion and incorporation into the emulsion.

Nanometer size particles may be formed, from about 50 nm to about 800 nm in volume average diameter, in embodiments from about 100 nm to about 400 nm in volume average diameter as determined, for example, by a Brookhaven nanosize particle analyzer.

After formation of the latex particles, the latex particles may be utilized to form a toner. In embodiments, the toners are an emulsion aggregation type toner that are prepared by the aggregation and fusion of the latex particles of the present disclosure with a colorant, and one or more additives such as surfactants, coagulants, waxes, surface additives, and optionally mixtures thereof.

The latex particles may be added to a colorant dispersion. The colorant dispersion may include, for example, submicron colorant particles in a size range of, for example, from about 50 to about 500 nanometers and, in embodiments, of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and may be from about 1 to about 25 percent by weight, and in embodiments from about 4 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, copper tetra(octadecyl sulfonamido) phthalocyanine, x-copper phthalocyanine pigment listed in the Color Index as Cl 74160, Cl Pigment Blue, Anthrathrene Blue identified in the Color Index as Cl 69810, Special Blue X-2137, diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 20 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

Wax dispersions may also be added to toners of the present disclosure. Suitable waxes include, for example, submicron wax particles in the size range of from about 50 to about 500 nanometers, in embodiments of from about 100 to about 400 nanometers in volume average diameter, suspended in an aqueous phase of water and an ionic surfactant, nonionic surfactant, or mixtures thereof. The ionic surfactant or nonionic surfactant may be present in an amount of from about 0.5 to about 10 percent by weight, and in embodiments of from about 1 to about 5 percent by weight of the wax.

The wax dispersion according to embodiments of the present disclosure may include, for example, a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasel K.K., and similar materials. In embodiments, commercially available polyethylene waxes possess a molecular weight (Mw) of from about 1,000 to about 1,500, and in embodiments of from about 1,250 to about 1,400, while the commercially available polypropylene waxes have a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight, and in embodiments from about 2 to about 20 percent by weight of the toner.

In embodiments, a coagulant may be added during or prior to aggregating the latex and the aqueous colorant dispersion. The coagulant may be added over a period of time from about 1 to about 20 minutes, in embodiments from about 1.25 to about 8 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 2 percent by weight of the toner, and in embodiments from about 0.1 to about 1.5 percent by weight of the toner.

Any aggregating agent capable of causing complexation might be used in forming toner of the present disclosure. Both alkali earth metal or transition metal salts can be utilized as aggregating agents. In embodiments, alkali (II) salts can be selected to aggregate sodio sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like.

Stabilizers that may be utilized in the toner formulation processes include bases such as metal hydroxides, including sodium hydroxide, potassium hydroxide, ammonium hydroxide, and optionally mixtures thereof. Also useful as a stabilizer is a composition containing sodium silicate dissolved in sodium hydroxide.

The resultant blend of latex, optionally in a dispersion, colorant dispersion, optional wax, optional coagulant, and optional aggregating agent, may then be stirred and heated to a temperature below the Tg of the latex, in embodiments from about 30° C. to about 60° C., in embodiments of from about 45° C. to about 55° C., for a period of time from about 0.2 hours to about 6 hours, in embodiments from about 1 hour to about 2.5 hours, resulting in toner aggregates of from about 3 microns to about 15 microns in volume average diameter, in embodiments of from about 4 microns to about 8 microns in volume average diameter.

In embodiments, a shell may then be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 45° C. to about 70° C., in embodiments from about 50° C. to about 65° C.

In embodiments, the shell latex may be functionalized with a group that imports hydrophobicity to the shell latex, thereby providing the shell with excellent sensitivity to relative humidity. Suitable functional groups include, for example, silanes such as (methacryloxymethyl)bis(trimethylsiloxy) methylsilane, (methacryloxymethyl)dimethylethoxysilane, (methacryloxymethyl)phenyldimethylsilane, methacryloxypropyldimethylethoxysilane, methacryloxypropylmethylsiloxane-dimethylsiloxane copolymer, methacryloxypropylsilsesquioxanyl-T8-silsesquioxane, 3-methacryloxypropyldimethylchlorosilane, 2-trimethylsiloxyethylacrylate, (3-acryloxypropyl)methyldichlorosilane, (3-acryloxypropyl)trimethoxysilane, 3-(N-allylamino)propyltrimethoxysilane, allylaminotrimethylsilane, and combinations thereof; and fluoro functional monomers including fluoro acrylates such as 2,2,3,3,4,4,4-heptafluorobutyl acrylate; fluoro methacrylates such as 2,2-trifluoroethyl methacrylate and 2,2,3,3,3-pentafluoropropyl methacrylate; and fluoro styrenes such as 4-(trifluoromethyl) styrene, 4-fluorostyrene, 2,6-difluorostyrene, and combinations thereof.

The shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns.

Once the desired final size of the toner particles is achieved, the pH of the mixture may be adjusted with a base to a value of from about 5 to about 7, and in embodiments from about 6 to about 6.8. The base may include any suitable base such as, for example, alkali metal hydroxides such as, for example, sodium hydroxide, potassium hydroxide, and ammonium hydroxide. The alkali metal hydroxide may be added in amounts from about 6 to about 25 percent by weight of the mixture, in embodiments from about 10 to about 20 percent by weight of the mixture.

The mixture of latex, colorant and optional wax is subsequently coalesced. Coalescing may include stirring and heating at a temperature of from about 90° C. to about 99° C., for a period of from about 0.5 to about 12 hours, and in embodiments from about 2 to about 6 hours. Coalescing may be accelerated by additional stirring.

The pH of the mixture is then lowered to from about 3.5 to about 6 and in embodiments, to from about 3.7 to about 5.5 with, for example, an acid to coalesce the toner aggregates. Suitable acids include, for example, nitric acid, sulfuric acid, hydrochloric acid, citric acid or acetic acid. The amount of acid added may be from about 4 to about 30 percent by weight of the mixture, and in embodiments from about 5 to about 15 percent by weight of the mixture.

The mixture is cooled in a cooling or freezing step. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture is not feasible nor practical, neither by the introduction of a cooling medium into the toner mixture, nor by the use of jacketed reactor cooling.

After this cooling, the aggregate suspension may be heated to a temperature at or above the Tg of the first latex used to form the core and the Tg of the second latex used to form the shell to fuse the shell latex with the core latex. In embodiments, the aggregate suspension may be heated to a temperature from about 80° C. to about 120° C., in embodiments from about 85° C. to about 98° C., for a period of time from about 1 hour to about 6 hours, in embodiments from about 2 hours to about 4 hours, to fuse the shell latex with the core latex.

The toner slurry may then be washed. Washing may be carried out at a pH of from about 7 to about 12, and in embodiments at a pH of from about 9 to about 11. The washing is at a temperature of from about 30° C. to about 70° C., and in embodiments from about 40° C. to about 60° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The toner may also include charge additives in effective amounts of, for example, from about 0.1 to about 10 weight percent, in embodiments from about 0.5 to about 7 weight percent. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, mixtures thereof, and the like.

Further optional additives which may be combined with a toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 10 weight percent, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight, in embodiments from about 0.1 to about 2 percent by weight of the toner, which additives can be added during the aggregation or blended into the formed toner product.

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

The resultant toner particles have less sensitivity to relative humidity compared with conventional toners due to their increased surface hydrophobicity from the introduction of the functionalized latex as the shell of the toner.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.9 to about 0.99, in embodiments from about 0.92 to about 0.98.

Toners of the present disclosure possess excellent humidity resistant toner properties, such as the ratio of J-zone charge to A-zone charge is from about 1.15 to about 2.55, in embodiments from about 1.2 to about 2, and wherein the ratio of J-zone charge to B-zone charge is from about 1 to about 2, in embodiments from about 1.05 to about 1.5, wherein the A-zone is at about 80 percent relative humidity, the B-zone is at about 50 percent relative humidity, and the J-zone is at about 10 percent relative humidity.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

EXAMPLES

Example 1

Silane-Functional Latex Synthesis. A core-shell silane-functional latex was prepared by in-situ seeded semi-continuous emulsion copolymerization of styrene and n-butyl acrylate (BA), in which methacryloxypropyl trimethoxylsilane (Aldrich) was used as the functional comonomer for the synthesis of the shell.

About 1.1 grams of DOWFAX™ 2A1 (47% aq.), and about 736 grams of deionized water were charged in a 2 liter jacketed stainless steel reactor with double P-4 impeller set at about 300 revolutions per minute (rpm), and deaerated for about 30 minutes while the temperature was raised to about 75° C. A monomer emulsion was prepared by agitating a monomer mixture (about 630 grams of styrene, about 140 grams of n-butyl acrylate, and about 5.4 grams of 1-dodecanethiol) with an aqueous solution (about 15.3 grams of DOWFAX™ 2A1, and about 368 grams of deionized water) at about 300 rpm at a temperature from about 21° C. to about 23° C. About 11.9 grams of the resulting emulsion mixture was taken from the monomer emulsion as the seed emulsion and added into the reactor and stirred for about 8 minutes at about 75° C. An initiator solution prepared from about 11.6 grams of ammonium persulfate in about 57 grams of deionized water was added over about 20 minutes. Stirring continued for about an additional 20 minutes to allow seed particle formation. The first half of the remaining monomer emulsion was fed into the reactor over about 130 minutes. A latex core having a particle size of about 150 nm was formed at this point, with a Mw of about 50 kg/mole as determined by gel permeation chromatography (GPC).

About 12 grams of methacryloxypropyl trimethoxylsilane and about 6.5 grams 1-dodecanethiol were then added into the remaining monomer emulsion, and stirred at about 300 rpm for about 10 minutes. Then, the new monomer emulsion was fed into the reactor over a period of about 90 minutes. After that, a polymer shell with silane functional groups on the particle surface was formed around the core. The shell had a thickness of about 40 nm.

At the conclusion of the monomer feed, the emulsion was post-heated at about 75° C. for about 3 hours, and then cooled to about 35° C. The reaction system was deoxygenated by passing a stream of nitrogen throughout the reaction.

The resulting core-shell latex had an average particle size of about 190 nm, a Mw of about 35 kg/mole (GPC), and a Tg of about 59° C., with about 41 percent solids. This latex was very stable and sediment-free.

While not wishing to be bound by any theory, it is believed the silane functional monomer was incorporated into the latex shell polymer chains mainly by copolymerization, and possibly also by hydrolysis. As the silane contained at least one carbon-carbon double bond, it could undergo free radical polymerization or a similar polymerization mechanism. The silane compound also contained at least one alkoxy group, which could be hydrolyzed with acid or base catalysts. It is believed that most of the hydrolysis of the silane group was completed after polymerization and the aggregation/coalescence process.

Example 2

A control toner was prepared as follows. About 11.78 kg of a poly(styrene-co-n-butyl acrylate) latex was produced following the procedures described above in Example 1, except about 23 grams of a functional monomer (β-Carboxyethyl acrylate (Beta-CEA)) was added into the initial monomer emulsion, and no methacryloxypropyl trimethoxylsilane was added.

About 5.55 kg carbon Black PD021702 dispersion (from Sun Chemicals Co.), about 3.82 kg PolyWAX-655 dispersion (from Baker Petrolite), about 0.187 kg of poly(aluminum chloride) (from ASADA CO.), were added to about 1.68 kg of about 0.02M $HNO_3$ solution and about 35.25 kg deionized water and then mixed at about 20° C. for about 50 minutes. The reaction temperature was then raised to about 56° C., and the slurry was aggregated for about 3 hours. About 7.58 kg of the above poly(styrene-co-n-butyl acrylate) latex was then added dropwise. After the addition, the slurry was mixed for about 1.2 hours, then about 2.066 kg of about 1 M NaOH was added into the slurry. After mixing for about 15 minutes, the reaction temperature was raised to about 96° C. The pH of the slurry was adjusted to about 4.17 by the addition of about 0.3 M $HNO_3$ solution. After the pH adjustment, the slurry was coalesced for about 2.5 hours. The toner particles were collected by filtration, washed, and dried.

A toner of the present disclosure was then prepared having a silane-functional shell latex. Following the process described above for the control, but before adding shell latex, about 1.2 kg of the control slurry was transferred to a 2-liter reactor pre-heated to about 60° C. Then, about 0.11 kg of the silane-latex prepared above in Example 1 was added into the reactor. The reaction temperature was then raised to about 96° C. The pH of the slurry was adjusted to about 4.1 by about 1 M NaOH solution. After the pH adjustment, the slurry was coalesced for about 1.5 hours. The toner particles were collected by filtration.

Example 3

A second toner of the present disclosure was prepared having a fluoro-functional shell latex. The fluoro-functional latex was prepared following the procedure set forth above in Example 1, except about 14 grams of a fluoro monomer, 2,6-difluorostyrene, was added to the latex instead of a silane latex.

Then, a toner was prepared utilizing a fluoro-latex as the shell. Following the process described above for the control toner in Example 2, but before adding shell latex, about 1.2 kg of the control slurry was transferred to a 2-liter reactor pre-heated to about 60° C. Then, about 0.11 kg of the fluoro-latex prepared above was added into the reactor. The reaction temperature was then raised to about 96° C. The pH of the slurry was adjusted to about 4.1 by about 1 M NaOH solution. After the pH adjustment, the slurry was coalesced for about 1.5 hours. The toner particles were collected by filtration.

After washing and drying, the properties of the control toner particles of Example 2, the toner having a silane-latex shell of Example 2, and the toner having a fluoro-latex shell described above were determined. Particle size was determined by a Layson Cell/Coulter LS230. Circularity was determined by a SysMex FPIA 2100. Triboelectric charge was determined by a Keithley Model 617 digital electrometer. Temperature and relative humidity settings for the A-zone was about 80° F. and about 80%; for the B-Zone was about 70° F. and about 50%; and for the J-Zone was about 70° F. and about 10%. The properties of these toners are summarized in Table 1 below.

TABLE 1

Comparison of Toner Particle Properties

| | Particle size, um | Circularity (at 1.5 hrs coalescence) | Tg (° C.) | A-zone tribo, mC/g | B-Zone tribo, mC/g | J-zone tribo, mC/g | J/A | J/B |
|---|---|---|---|---|---|---|---|---|
| Control | 5.9 | 0.939 | 59 | 33.51 | 52.06 | 66.53 | 1.99 | 1.28 |
| Silane Shell | 6.45 | 0.935 | 58.9 | 34.03 | 48.6 | 53.1 | 1.56 | 1.09 |
| Fluoro Shell | 6.31 | 0.94 | 59.1 | 35.3 | 49.1 | 52.2 | 1.48 | 1.06 |

As is apparent from Table 1, the difference in triboelectric charging between A-zone and J-zone for the control was about 33 mC/g, while for the toner of the present disclosure with silane in the shell latex, was about 19 mC/g and for the toner of the present disclosure with fluoro in the shell latex, was about 17 mC/g. These results demonstrate that the toner of the present disclosure had much less sensitivity to relative humidity than the control toner.

Figure 2:
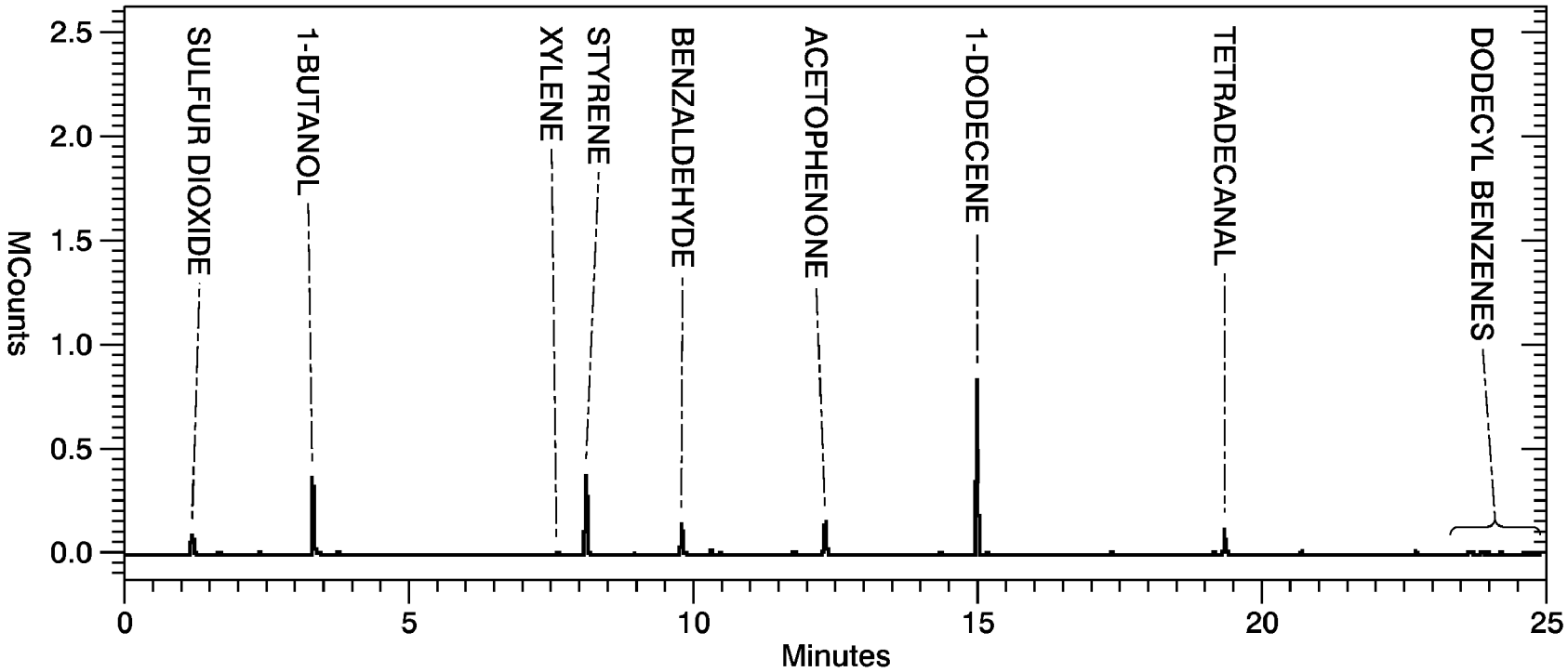
FIG. 2 includes a graph depicting GC/MS test results of a toner of the present disclosure.

The degradation behavior of the control toner and the silane shell toner was monitored by gas chromatography/mass spectroscopy (GC/MS) using a Hewlett Packard 6890, and compared with the control toner of Example 2. The results of these GC/MS analyses are set forth in FIGS. 1 and 2. FIG. 1 is the GC/MS for the control toner and FIG. 2 is the GC/MS for the toner of the present disclosure having a silane in the shell. The molecular weight range of the ions detected by the instrument was from about 50 to about 650. The GC/MS results detail the various species/compounds detected in the toner and control toner. With silane in the shell latex, the toner particles were more stable, compared with the control.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner comprising:

a core comprising a first latex having a glass transition temperature from about 45° C. to about 65° C., a colorant, and an optional wax; and a shell comprising a second latex having a glass transition temperature from about 45° C. to about 70° C. functionalized with a monomer selected from the group consisting of silanes, fluoro acrylates, fluoro methacrylates, fluoro styrenes, and combinations thereof;

wherein the first latex and the second latex are the same or different and are selected from the group consisting of styrenes, acrylates, methacrylates, butadienes, isoprenes, acrylic acids, methacrylic acids, acrylonitriles, and combinations thereof.

2. A toner as in claim 1, wherein the first latex and the second latex are the same or different and are selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

3. A toner as in claim 1, wherein the functional groups of the second latex are selected from the group consisting of (methacryloxymethyl)bis(trimethylsiloxy)methylsilane, (methacryloxymethyl)dimethylethoxysilane, (methacryloxymethyl)phenyldimethylsilane, methacryloxypropyldimethylethoxysilane, methacryloxypropylmethylsiloxane-dimethylsiloxane copolymers, methacryloxypropylsilsesquioxanyl-T8-silsesquioxane, 3-methacryloxypropyldimethylchlorosilane, 2-trimethylsiloxyethylacrylate, (3-acryloxypropyl)methyldichlorosilane, (3-acryloxypropyl)trimethoxysilane, 3-(N-allylamino)propyltrimethoxysilane, allylaminotrimethylsilane, 2,2,3,3,4,4,4-heptafluorobutyl acrylate, 2,2,3,3,3-pentafluoropropyl methacrylate, 4-(trifluoromethyl)styrene, 4-fluorostyrene, 2,6-difluorostyrene, and combinations thereof.

4. A toner as in claim 1, wherein the first latex comprises a poly(styrene-butyl acrylate), and the second latex comprises a poly(styrene-butyl acrylate) functionalized with monomer selected from the group consisting of methacryloxypropyl trimethoxylsilane and 2,6-difluorostyrene.

5. A toner as in claim 1, wherein the toner particles have a size from about 1 micron to about 20 microns.

6. A toner as in claim 1, wherein the toner particles possess a ratio of J-Zone charge to B-Zone charge from about 1 to about 2, and a ratio of J-Zone charge to A-Zone charge from about 1.15 to about 2.55.

* * * * *